United States Patent [19]

Panchanathan

[11] Patent Number: 4,900,374

[45] Date of Patent: Feb. 13, 1990

[54] DEMAGNETIZATION OF IRON-NEODYMIUM-BORON TYPE PERMANENT MAGNETS WITHOUT LOSS OF COERCIVITY

[75] Inventor: Viswanathan Panchanathan, Anderson, Ind.

[73] Assignee: General Motors Corporation, Detroit, Mich.

[21] Appl. No.: 397,826

[22] Filed: Aug. 24, 1989

[51] Int. Cl.[4] ..... H01F 1/02

[52] U.S. Cl. ..... 148/101; 148/120; 148/121

[58] Field of Search ..... 148/100, 101, 102, 103, 148/120, 121, 122

[56] References Cited

U.S. PATENT DOCUMENTS 4,792,367 12/1988 Lee ..... 148/104

4,802,931 2/1989 Croat ..... 148/302

*Primary Examiner*—John P. Sheehan

*Attorney, Agent, or Firm*—George A. Grove

[57] ABSTRACT

Hot worked, fine grain, permanent magnets of the iron-neodymium-boron type can be demagnetized by heating in air for a period of minutes at a temperature in the range of 100° C. to 300° C. above their Curie temperature without significant loss of coercivity.

3 Claims, 1 Drawing Sheet

DEMAGNETIZATION OF IRON-NEODYMIUM-BORON TYPE PERMANENT MAGNETS WITHOUT LOSS OF COERCIVITY

This invention pertains to the manufacture of hot worked, fine grain, anisotropic permanent magnets of iron-neodymium-boron type compositions. More specifically, this invention pertains to a method of demagnetizing such magnets without reducing the coercivity of the demagnetized body.

BACKGROUND OF THE INVENTION

Lee, U.S. Pat. No. 4,792,367, issued Dec. 20, 1988, demonstrated that very fine grained compositions of certain transition metals including iron, rare earth elements including neodymium and/or praseodymium, and relatively small amounts of boron can be suitably hot worked to form very strong anisotropic permanent magnets. Lee's process is applicable to compositions of the type disclosed by Croat in U.S. Pat. No. 4,802,931 issued Feb. 7, 1989.

Croat disclosed permanent magnet compositions containing as the essential magnetic phase very small grains of tetragonal crystals of $RE_2TM_{14}B$ where RE is one or more rare earth elements including neodymium and/or praseodymium, and TM is preferably iron or mixtures of iron and cobalt. While $RE_2TM_{14}B$ (for example, $Nd_2Fe_{14}B$) is the essential and predominant phase, preferred compositions also contain a relatively small amount of one or more grain boundary phases containing rare earth elements and transition elements and sometimes boron. Typically, the grain boundary phase is richer in rare earth element content than the principal phase. The grain boundary phase which surrounds the larger grains of the $RE_2TM_{14}B$ phase is believed to provide magnetic coercivity in such material by pinning the magnetic domain walls formed in the larger grains when the material is placed in a magnetic field. In general, suitable overall compositions for the preparation of such permanent magnets comprise in terms of atomic percentage about 50 to 90 percent transition metal, about 10 to 40 percent rare earth metal and at least 0.5 percent boron.

Alloys of such composition were melted and very rapidly solidified such as, for example, by melt spinning to produce a fine grain microstructure. The material was processed to obtain a material in which the average grain size of the principal phase was in the range of 20 to 300 nanometers. Materials of such microstructure could be obtained either directly upon melt spinning or by a practice of overquenching to an amorphous material and annealing to obtain the desired grain size. These practices are disclosed in the above-identified Croat patent.

The Croat-type compositions had appreciable coercivity and in general were magnetically isotropic. The melt-spun or melt-spun and annealed particles could be pulverized if desired into a powder of average size of a few microns to 350 microns. The powder could be consolidated with a suitable resin to form a unitary magnet body having no preferred direction of magnetization. Such magnet materials have many useful applications. However, their maximum magnetic properties are not appropriate for applications in which higher strength anisotropic magnets would better serve.

Lee's patent describes the hot pressing of the Croat magnetically isotropic powder to form a full density magnetic body that was generally isotropic but displayed some magnetic anisotropy in the direction in which the particles were pressed. However, Lee found that upon further hot working of his original hot pressed compact, even stronger, more definitely anisotropic permanent magnets could be formed. Further development of the Lee practice has centered on the hot working techniques for the iron-neodymium-boron type materials so as to achieve ever more complete alignment of the 2-14-1 grains and greater anisotropy and magnetic properties. The term "2-14-1" is a shorthand reference to $RE_2TM_{14}B$ grains or to compositions containing or based upon such a tetragonal crystalline phase.

Sometimes in the manufacture or usage of these strong permanent magnets it is desired to demagnetize them to facilitate handling or shaping. It is known that these magnets can be demagnetized by heating them above the Curie temperature for a few minutes. The Curie temperature of these 2-14-1 magnets depends upon their composition but is typically of the order of 300° C. to 500° C. The difficulty with demagnetizing these magnets by this practice is that the magnet then possesses a lower value of coercivity than it has in its manufactured state. It is an object of the present invention to provide a method of demagnetizing hot worked, fine grain 2-14-1 type magnets such that any loss of coercivity is minimized or eliminated. In many instances, it is possible to obtain a modest increase in coercivity by the practice of this invention.

BRIEF SUMMARY OF THE INVENTION

In accordance with a preferred embodiment of my invention, these and other objects of my invention are accomplished as follows.

In the hot pressing and hot working of fine grained 2-14-1 magnets, such thermomechanical treatment is carried out at a suitable elevated temperature preferably over 700° C. for a time sufficient to obtain full densification of the material, the formation of a suitable fine grain microstructure and substantial plastic deformation so as to align the preferred magnetization direction of as many of the grains as possible. Hot working tends to flatten the grains perpendicular to the direction of material flow. Furthermore, the processing is controlled so that the average major dimension of the flattened grains is below about 500 to 1000 nanometers.

The resulting magnets can be magnetized to very strong magnets. Upon removal of a magnetizing or other magnetic field, they possess high remanent magnetization. Upon application of a magnetic field aligned opposite to their magnetic field, i.e., a reverse field, they display high coercivity. They are capable of displaying high maximum energy products. If there is a need to demagnetize such magnets, it is desirable to preserve these properties.

I have found that these magnets can be advantageously demagnetized by heating them at an elevated temperature well above their Curie temperature. I have found that they may be demagnetized without loss of coercivity by heating them for a few minutes at a temperature in the range of 100° C. to 300° C. above their Curie temperature. In a preferred embodiment, my demagnetization temperature is in the range from about 175° C. to 250° C. above the Curie temperature of the particular magnet. Surprisingly, by heating the magnets to such high temperatures for demagnetization, loss in coercivity is minimized or avoided. Indeed, in many instances, an increase in coercivity can be obtained.

DESCRIPTION OF THE DRAWINGS

Other advantages of my invention will be better appreciated from a detailed description of its practice. During the description, reference will be had to the drawings in which.

DETAILED DESCRIPTION OF THE INVENTION

The practice of my invention will be better understood from illustrative examples with respect to specific compositions.

In the following examples, alloys of the specified compositions were prepared by induction melting a mixture of the individual constituents under argon in an alumina vessel. The alloy was then remelted by induction heating under argon atmosphere and ejected from an alumina lined vessel through a 0.032 inch diameter orifice onto the rim of a rotating metal substrate quench wheel. The wheel was water cooled. The samples were melt spun in an argon atmosphere with a wheel rim speed of about 35 meters per second. The molten alloys were converted by this melt spinning practice to ribbon fragments a few microns thick and about 10 millimeters wide.

The quench rate of all samples used herein was such that the material was generally amorphous in its microstructure. Insofar as obtaining optimum permanent magnet properties in accordance with the above-identified Croat patent is concerned, the material was overquenched. It was amorphous in microstructure or of a grain size too small to display significant coercivity. However, subsequent hot pressing and hot working operations will produce sufficient grain growth for permanent magnet properties.

The material was pulverized to particles of 45 to 250 micrometers.

In each of the following examples, a portion of the specific melt-spun composition was placed under argon atmosphere in a die heated to 750° C. The material was allowed to come to the temperature of the die over a period of about 1½ minutes and then pressed at 750° C. and a pressure of 15,000 psi (103.4 MPa). A fully densified body in the form of a right cylinder 0.98 inches in diameter and 0.5 inches thick was formed. The total processing time was about two minutes. The hot pressed products have generally spherical grains about 50 nanometers in diameter. These hot pressed, fully densified samples were the starting materials for the following examples.

The hot pressed pieces were then placed in a hot die of 1.50 inch diameter. The sample was heated to 750° C. and die upset to form a fully dense, hot worked (by die upsetting), pancake-like cylindrical body 1.50 inch in diameter and 0.23 inch thick. The total processing time was about two minutes. The sample was removed from the die and cooled in air to room temperature.

The above practice was used to prepare hot pressed and die upset work pieces for the following examples.

EXAMPLE 1

A die upset magnet was prepared by the above-described practice of a composition by weight of 10 percent cobalt, 30.5 percent total rare earth elements, mostly neodymium and praseodymium, 0.9 percent boron and the balance iron except for relatively small amounts of incidental impurities. In this and the following examples, the rare earth content of 30.5 weight percent consists of 29.5 to 30.0 percent neodymium, 0.3 to 0.7 percent praseodymium and the balance other rare earth elements.

Figure 1:
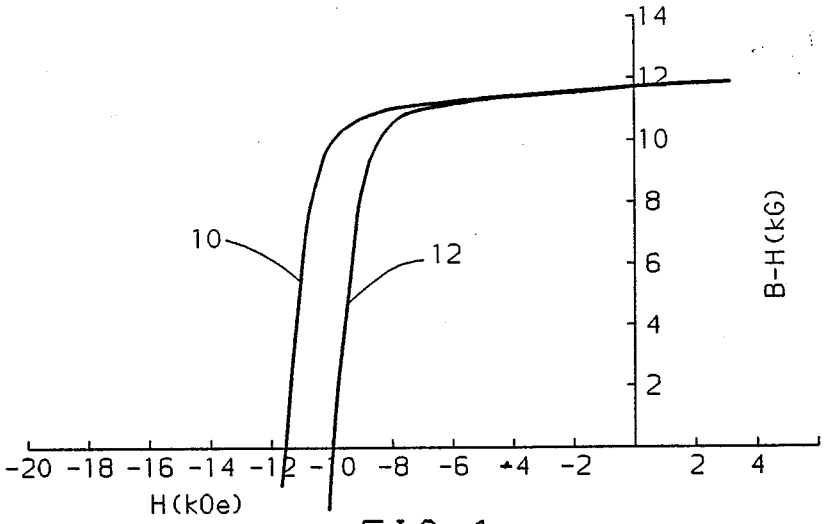
FIG. 1 comprises demagnetization curves of a hot worked iron-neodymium-boron magnet containing 10 weight percent cobalt before and after demagnetization at 420° C.

The magnetic properties of this magnet were determined using a Hysteresisgraph magnetometer. The demagnetization curve (B-H versus H) is reproduced in FIG. 1 as curve 10. The properties of the sample were as follows: $B_r = 11.5$ kiloGauss (kG); coercivity, $H_{ci}$, $= 11.6$ kiloOersteds (kOe); and maximum energy product $= 31.4$ megaGaussOersteds (MGOe). The Curie temperature of this magnet was about 410° C. The magnet was heated in air (i.e., in a nonprotective atmosphere) in a furnace at 420° C. and held for 20 minutes to completely remove its permanent magnet properties. A specimen was then remagnetized in a magnetometer and subjected to a reverse field. The magnetic properties of this heated specimen are depicted in curve 12 of FIG. 1. It is seen that the remanence, $B_r$, is substantially unchanged, but there has been a significant decrease in coercivity to a level of 10 kOe. This illustrates the disadvantage of demagnetizing by the prior art practice of heating to a temperature just above the Curie temperature of the magnet.

Figure 2:
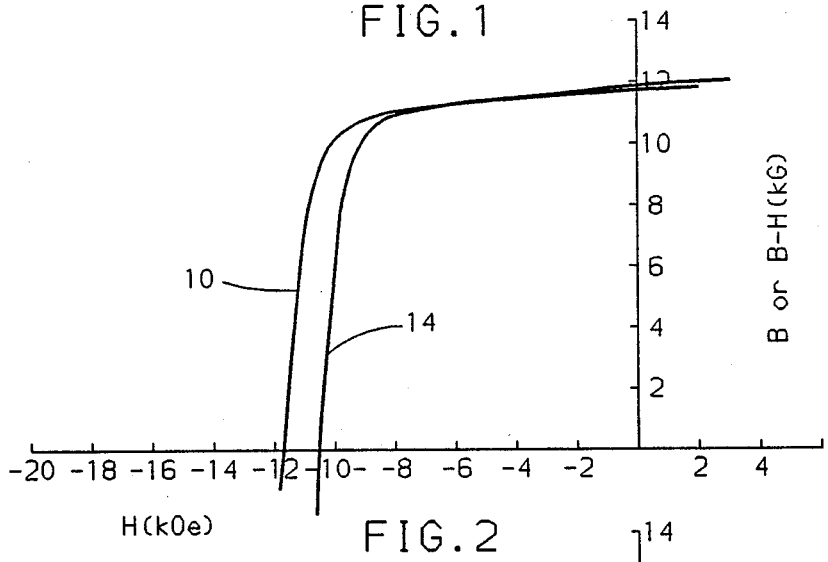
FIG. 2 comprises demagnetization curves of a hot worked iron-neodymium-boron magnet containing 10 weight percent cobalt before and after demagnetization at 500° C.

Another sample of a die upset magnet of this composition was demagnetized by heating in air in a furnace at 500° C. and held at that temperature for 20 minutes. The initial magnetic properties of the sample are again illustrated at curve 10 of FIG. 2. Upon remagnetization of this demagnetized sample, the magnetic properties are illustrated at curve 14 of FIG. 2. It is seen that while demagnetization at 500° C. resulted in a coercivity loss, the loss is not as great as was realized in the sample demagnetized at 420° C. This is seen by comparing demagnetization curve 12 of FIG. 1 with demagnetization curve 14 of FIG. 2.

Figure 3:
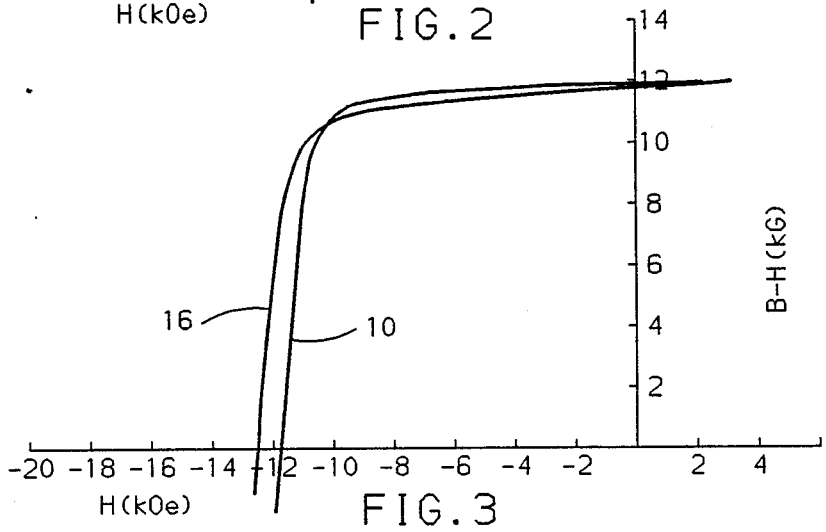
FIG. 3 comprises demagnetization curves of a hot worked iron-neodymium-boron magnet containing 10 weight percent cobalt before and after demagnetization at 600° C.

A third specimen of this hot pressed composition was demagnetized by heating in air for 20 minutes at 600° C. For comparison, the initial magnetic properties of the sample are included as curve 10 in FIG. 3. After remagnetization of the 600° C. sample, its magnetic properties are illustrated in curve 16 of FIG. 3. The coercivity of this sample is about 12.5 kOe with substantially no change in its remanence. Thus, by demagnetizing this cobalt-iron-neodymium-boron magnet at 600° C. instead of at its Curie temperature, the advantageous magnetic properties of the material were retained and even slightly improved.

EXAMPLE 2

Die upset magnets were prepared by the practice described above and composed by weight of 10 percent cobalt; 30.5 percent rare earth elements, mostly neodymium as described above; 0.9 percent boron; 0.6 percent gallium and the balance iron except for relatively small amounts of impurities. The initial magnetic properties of a sample of these magnets were: $B_r$=11.8 kG, $H_{ci}$=17.2 kOe and maximum energy product =33.0 MGOe. The Curie temperature of this magnet composition is 410° C.

One of these die upset magnet samples was demagnetized by heating at 550° C. for 20 minutes. The demagnetized sample was then reexamined in a magnetometer. Its remanence increased a small but detectable amount, but its coercivity decreased to about 16 kOe.

Another sample of this die upset magnet composition was demagnetized by heating at 600° C. for 20 minutes. Upon reexamination in the magnetometer, the remanence was substantially the same as that of the initial sample, but the coercivity had increased to 17.2 kOe.

Still another sample of this die upset magnet composition was demagnetized by heating at 650° C. for 20 minutes. Upon reexamination in the magnetometer, it was determined that its coercivity was then about 17.2 kOe.

EXAMPLE 3

Several die upset magnets were prepared by the above-described practice. They were composed by weight of 15 percent cobalt; 30.5 percent total rare earth, mostly neodymium; 0.9 percent boron; 0.6 percent gallium and the balance iron except for impurities. The Curie temperature of this composition was about 470° C. The initial magnetic properties of the hot pressed magnets were: $B_r$=12.1 kG, $H_{ci}$=15.9 kOe and maximum energy product=34.8 MGOe. When a sample of this die upset magnet composition was demagnetized at a temperature just 5 to 10 degrees above its Curie temperature, the magnet experienced a significant decrease in coercivity upon subsequent remagnetization.

A sample was then demagnetized by heating for seven minutes at 700° C. When this sample was examined in a magnetometer, it was found that its remanence was the same as the initial sample and that its coercivity had increased to 16.2 KOe.

EXAMPLE 4

Another series of die upset magnets was prepared of a composition by weight of 30.5 percent total rare earth (mostly neodymium), 1.1 percent boron, and the balance iron except for impurities. The initial magnetic properties of these samples were $B_r$=12.6 kG, $H_{ci}$=9.2 kOe and maximum energy product=37.8 MGOe. The Curie temperature of this composition was about 305° C.

A sample was demagnetized by heating at 315° C. for 30 minutes. The remanence remained subsequently unchanged as compared to the initial sample but the coercivity dropped to 8.6 kOe.

A sample of this die upset magnet composition was demagnetized by heating at 500° C. for 30 minutes. The remanent magnetization remained substantially unchanged. The coercivity increased to about 10.8 kOe.

In general, I have discovered that fine grained, hot worked iron-neodymium-boron magnets of the type described may advantageously be demagnetized by heating for a period of a few minutes, up to 20 to 30 minutes, at a temperature in the range of about 100° C. to 300° C. above the Curie temperature of the specific composition. Usually, it is preferred to heat them at a temperature of about 175° C. to 250° C. above the Curie temperature for a period of a few minutes. By demagnetizing these specific magnet materials in this way, any loss in intrinsic coercivity of the magnet is minimized or avoided altogether. As shown in the above examples, frequently there is obtained a modest increase in the coercivity of the material Certain preferred compositions amenable to the practice of this invention have been disclosed. To better summarize, my invention may be practiced on permanent magnet compositions in which the predominant constituent is the tetragonal crystal phase of $RE_2TM_{14}B$. RE can be any rare earth element, but 60% or more of the rare earth content of the magnet shall consist of neodymium and/or praseodymium. Frequently cerium, lanthanum, and samarium and yttrium are present in commercial sources of neodymium and praseodymium. TM is principally iron and cobalt. Outer metals may be present in minor amounts or as impurities. These include metals such as W, Cr, Ni, Al, Cu, Mn, Mg, Ga, Nb, V, Mo, Ti, Zr, Sn and Ca. Si is usually present in small amounts as are $O_2$ and $N_2$.

While my invention has been described in terms of a specific embodiment thereof, it will be appreciated that other compositions could be readily adapted by one skilled in the art. Accordingly, the scope of my invention is to be considered limited only by the following claims.

The embodiments of the invention in which an exclusive property or privilege is claimed are defined as follows:

1. A method of demagnetizing a permanent magnet so as to minimize loss of coercivity, the permanent magnet comprising fine grains of the tetragonal crystal phase of $RE_2TM_{14}B$ composition where RE is neodymium and/or praseodymium or mixtures of them with lesser quantities of other rare earth elements and TM is iron and mixtures of iron and cobalt, the method comprising heating the magnet at a temperature in the range of 100° C. to 300° C. above its Curie temperature to demagnetize the magnet such that upon cooling to normal room temperature the magnet possesses a coercivity no less than the coercivity prior to demagnetization.

2. A method of demagnetizing a hot worked, anisotropic permanent magnet so as to minimize loss of coercivity, the permanent magnet comprising fine grains of the tetragonal crystal phase of $RE_2TM_{14}B$ composition where RE is neodymium and/or praseodymium or mixtures of them with lesser quantities of other rare earth elements and TM is iron and mixtures of iron and cobalt, the method comprising heating the magnet in air at a temperature in the range of 100° C. to 300° C. above its Curie temperature to demagnetize the magnet such that upon cooling to normal room temperature the magnet possesses a coercivity no less than the coercivity prior to demagnetization.

3. A method of demagnetizing a hot worked, anisotropic permanent magnet so as to minimize loss of coercivity, the permanent magnet comprising fine grains of the tetragonal crystal phase of $RE_2TM_{14}B$ composition where RE is neodymium and/or praseodymium or mixtures of them with lesser quantities of other rare earth elements and TM is iron and mixtures of iron and cobalt, the method comprising heating the magnet in air for a period up to thirty minutes at a temperature in the range of 175° C. to 250° C. above its Curie temperature to demagnetize the magnet such that upon cooling to normal room temperature the magnet possesses a coercivity no less than the coercivity prior to demagnetization.

* * * * *